United States Patent [19]

Knickerbocker

[11] 4,343,525

[45] Aug. 10, 1982

[54] ELECTRICAL PANEL CONNECTOR HOLD-DOWN ADAPTER

[75] Inventor: Robert H. Knickerbocker, Cheshire, Conn.

[73] Assignee: The Siemon Company, Watertown, Conn.

[21] Appl. No.: 145,621

[22] Filed: May 1, 1980

Related U.S. Application Data

[63] Continuation-in-part of Ser. No. 128,108, Mar. 7, 1980, abandoned.

[51] Int. Cl.[3] ..... H01R 13/62

[52] U.S. Cl. ..... 339/75 P

[58] Field of Search ..... 339/75 R, 75 MP, 91 R; 179/13 BR; 24/209; 248/499

[56] References Cited

U.S. PATENT DOCUMENTS 3,313,511 4/1967 Koernar et al. ..... 298/499

4,043,627 8/1977 Ayer ..... 339/91 R X

*Primary Examiner*—Eugene F. Desmond

*Attorney, Agent, or Firm*—David S. Fishman

[57] ABSTRACT

An electrical panel connector hold-down adapter which permits electrical cable connectors of various size and shape to be easily and reliably secured to mating electrical panel connectors.

6 Claims, 10 Drawing Figures

ELECTRICAL PANEL CONNECTOR HOLD-DOWN ADAPTER

CROSS-REFERENCE TO RELATED APPLICATIONS

This application is a continuation-in-part of application Ser. No. 128,108 filed Mar. 7, 1980, now abandoned.

BACKGROUND OF THE INVENTION

This invention relates to reliably and easily preventing undesired separation of the mating portion of communication systems cable connectors. Specifically, this invention relates to securing electrical cable connectors to mating panel mounted connectors with ease through the use of a universal adapter characterized by minimal expense.

The major disadvantage with electrical cable and panel connectors is that they may disengage while in service. The prior art discloses numerous methods to alleviate this problem. Some cable and panel connectors are manufactured and designed so that they snap together. Other prior art connectors are manufactured so that the cable connector and the panel connector are both affixed to the mounting surface. Further previously employed methods of fastening the cable and panel connectors together involve the use of bale hooks, springs, or similar devices. Yet another prior art connector locking technique uses a plastic sheet wrap. In this technique a panel connector is disengaged from the mounting surface and a plastic sheet is secured between the panel connector and the panel. After the cable and panel connectors have been engaged, the plastic sheet is wrapped around both connectors and fastened.

While the prior art demonstrates methods of securing connector portions there still remains some shortcomings. Those prior art devices which are manufactured to be self-fastened cannot be employed with non-compatible connectors, thus limiting their use. All of the prior art techniques have the inherent deficiency that they can secure only one panel connector to one cable connector at a time. This results in a large expense because of the duplication in connecting parts. This also presents problems when installing connector assemblies close together and when disengaging the assemblies.

SUMMARY OF THE INVENTION

The present invention overcomes the above-discussed disadvantages of the prior art by creating a method of securing one or more connector assemblies despite their make or design. The apparatus in accordance with the present invention employs two brackets. Each bracket is fastened to the mounting surface adjacent a connector. The brackets are positioned so as to be on opposing sides of the connector assembly or assemblies to be secured. A strap is secured to the spaced brackets and then tightened over the connector assembly or assemblies. Alternatively, pairs of cooperating straps may be employed with one strap of each pair being attached to each of the spaced brackets and the desired tie-down being achieved by releasably connecting the straps to one another. This allows the tie-down of either one or more connectors easily and economically. Another advantage over the prior art is that the present invention permits the use of differentiated straps whereby the connector assembly or assemblies may be labeled according to function.

BRIEF DESCRIPTION OF THE DRAWING

The present invention may be better understood and its numerous objectives and advantages will become apparent to those skilled in the art by reference to the accompanying drawing wherein like reference numerals refer to like elements in the several FIGURES and wherein.

DESCRIPTION OF THE PREFERRED EMBODIMENT

Figure 1:
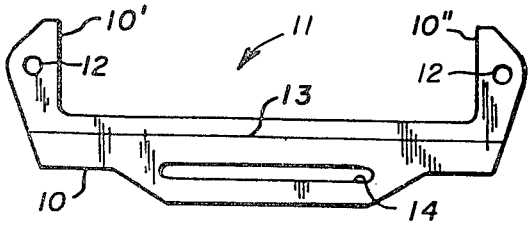
FIG. 1 is a top view of the flat blank of a bracket in accordance with a preferred embodiment.

Referring to FIG. 1, a metal flat blank which may be formed into one half of the electrical panel connector hold-down adapter in accordance with a preferred embodiment of the invention is shown. This flat blank resembles a squared C, in that it has an elongated flat bar 10 with perpendicular flat extensions 10' and 10'' at both ends. Extensions 10' and 10'' each have a circular cutout 12, or any other shape cutout, capable of allowing a screw, or any other type of fastening means, to pass therethrough. Flat bar 10 has a rectangular cutout 14, or any similar shape cutout or aligned cutouts, to allow the passage of a flat strap or straps therethrough. This metal flat blank is bent at an angle, along line 13, to form a bracket 11.

Figure 2:
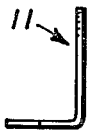
FIG. 2 is a cross-sectional side elevation view of the blank of FIG. 1 after forming into a bracket.
Figure 3:
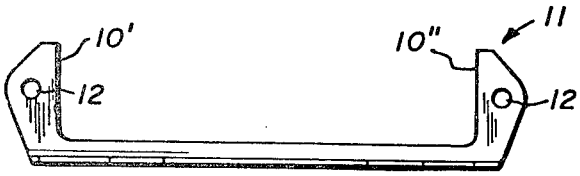
FIG. 3 is a top view of the bracket of FIG. 2.
Figure 4:
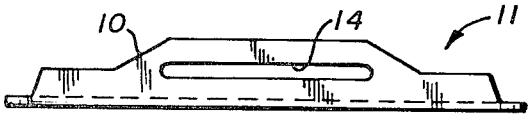
FIG. 4 is a frontal view of the bracket of FIG. 2.

With reference to FIG. 2, a cross-sectional view of the bracket 11 subsequent to bending is depicted. FIG. 3 is a top view of the completed bracket 11 showing extensions 10' and 10'' and FIG. 4 is a front view of the completed bracket 11 with flat bar 10.

Figure 5:
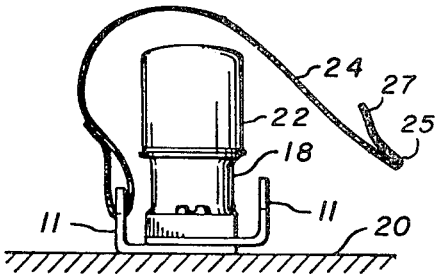
FIG. 5 is a cross-sectional view of the electrical panel connector hold-down adapter in the open position.

With reference now to FIG. 5, the open position of the electrical panel connector hold-down adapter is illustrated. The adapter includes two identical metal brackets 11 and a strap 24. Preferably, the strap 24 would be of the self-locking or mating Velcro type, that is one half of the strap 24 would consist of hooks while the other half of strap 24 would consist of loops. The extensions 10 of brackets 11 are placed between electrical panel connector 18 and the mounting surface 20. With brackets 11 and connector 18 fastened to the mounting surface 20, the two identical brackets 11 are positioned such that the first side of one bracket 11 is parallel to the first side of the other bracket 11 but on opposing sides of the panel connector 18. Strap 24 will have previously been passed through the cutout 14 of the first side of one of the brackets 11 and permanently secured thereto by, for example, heat sealing to itself. In order to facilitate insertion of the free end of strap 24 through the cutout 14 in the said other bracket 11, the strap is bent back on itself, as indicated at 25, to define a tab 27. The orientation of tab 27 with respect to the remainder of strap 24 will be caused to remain the same through the application of heat at the bend line 25. The formation of tab 27 has the added advantage, which may be seen from FIG. 6, of providing an upwardly extending strap portion which facilitates release of the hold-down adapter.

Figure 6:
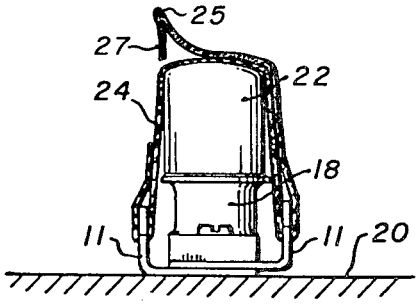
FIG. 6 is a cross-sectional view of the electrical panel connector hold-down adapter in the closed position.

FIG. 6 depicts the closed position of the electrical panel connector hold-down adapter. The electrical cable connector 22 is placed over the electrical panel connector 18. Strap 24 is then positioned over the cable connector 22 and passed through the cutout 14 in the first side of the other bracket 11 and fastened. In the preferred embodiment, using the Velcro type strap, the strap 24 half with the hooks is passed through cutout 14 and folded back over so as to contact the strap 24 half with the loops. While FIG. 5 and FIG. 6 depict the adapter for use with one connector assembly the adapter may be used with a plurality of connector assemblies. This will require the fastening of a bracket 11 under the two outermost panel connectors 18 so that the strap 24 or a plurality of straps may be positioned over all cable connectors 22. To disconnect, the hold-down adapters can be opened easily and quickly by pulling the interlocked sections of the Velcro strap apart.

Figure 7:
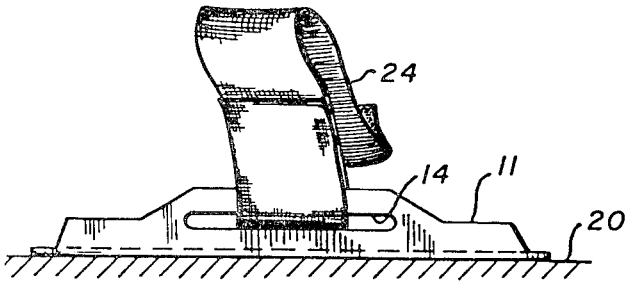
FIG. 7 is a side view of the electrical panel connector hold-down adapter.

FIG. 7 depicts the side view of the adapter showing the first side of bracket 11 defining the cutout 14 and strap 24.

Figure 8:
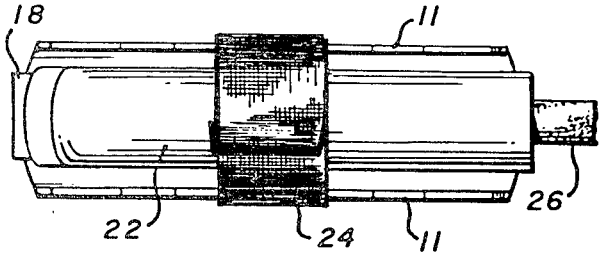
FIG. 8 is a top view of a first embodiment of the electrical panel connector hold-down adapter.

FIG. 8 depicts the top view of one embodiment of the adapter with a 90° panel connector 22. In this configuration cable 26 is at a 90° angle to the pins of cable connector 22.

Figure 9:
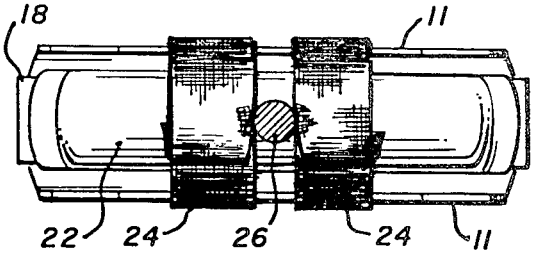
FIG. 9 is a top view of a second embodiment of the electrical panel connector hold-down adapter.

FIG. 9 depicts the top view of another embodiment of the adapter with a 180° panel connector 22. In this configuration cable 26 is in a direct line with the pins of the cable connector 22. Here two straps 24 are depicted, but two are not essential.

Figure 10:
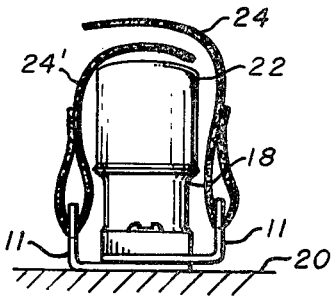
FIG. 10 is a side view of another embodiment of the present invention.

Referring now to FIG. 10, a further embodiment of the hold-down adapter in accordance with the present invention is shown. The adapter of FIG. 10 differs from the above-discussed adapters in that the strap 24 is in the form of two cooperating strap portions 24 and 24'. The strap portions 24 and 24' are permanently attached, for example by heat sealing as described above, to their respective brackets 11. In the FIG. 10 embodiment, again presuming Velcro straps, hold-down is accomplished by pulling strap 24', which may have the loops on a surface thereof, over the top of cable connector 22 and thereafter pulling strap 24, which would in the example being described have hooks on a surface thereof, in the opposite direction and then bringing it into contact with strap 24'.

While preferred embodiments have been shown and described, various modifications and substitutions may be made thereto without departing from the spirit and scope of the invention. Accordingly, it will be understood that the present invention has been described by way of illustration and not limitation.

What is claimed is:

1. An apparatus for holding electrical cable connectors to electrical panel connectors which are attached to a mounting surface, the electrical connectors having first and second opposite sides, the apparatus comprising:

two identical metal bracket means, said bracket means each having two angularly related sides, a first of said sides having at least a first elongated cutout and the second of said sides having two apertured extensions with each extension located at the outer extremity of said second side and in the plane of said second side, said second sides of both of said bracket means being intended to be fastened to the mounting surface by means of the apertures in said extensions, said first side of one of said bracket means being positioned generally parallel to the first side of at least one panel connector and the first side of the other of said bracket means being positioned generally parallel to the second side of said at least one panel connector whereby the apertures in said extensions may be superimposed and intercepted by common fasteners when said apparatus is fastened to a mounting surface; and strap means, said strap means passing through cutouts in the said first sides of both bracket means, said strap means being positioned over and in contact with a cable connector, said strap means being temporarily secured to itself and cooperating with said bracket means for holding the cable and panel connectors in engagement, said strap means being divided into two sections, said first section having a plurality of loops and said second section having a plurality of cooperating hooks.

2. The apparatus of claim 1 wherein said bracket means is formed by bending a flat blank to desired angle.

3. The apparatus of claim 2 wherein said strap means comprises:

a first strap, said first strap passing through the elongated cutout in a first of said bracket means and being permanently attached to itself to define a loop which retains said first strap on said first bracket means, said first strap being provided with a plurality of loops protruding from a first surface thereof; and a second strap, said second strap passing through the elongated cutout in the other of said bracket means and being permanently attached to itself to define a loop which retains said second strap on the said other bracket means, said second strap being provided with a plurality of hook-like members protruding from a first surface thereof, said first surface of said second strap facing said first surface of said first strap whereby said straps may be releasably and mechanically joined by bringing said first surfaces into contact thereby causing said hook-like members to engage said loops.

4. The apparatus of claim 1 wherein a first section of said strap means is fastened to a first of said bracket means and the second section of said strap means is passed through the elongated cutout in the first side of the other of said bracket means and folded back into contact with said first section of said strap means.

5. The apparatus of claim 1 wherein the second section of said strap means is fastened to a first of said bracket means and the first section of the said strap means is passed through the elongated cutout in the first side of the other of said bracket means and folded back into contact with said second section of said strap means.

6. The apparatus of claim 1 wherein said strap means first section is permanently attached to a first of said bracket means and said strap means second section is permanently attached to the other of said bracket means, said strap means first and second sections being separable when release of the cable and panel connectors is desired.

* * * * *